US007760055B2

(12) United States Patent
Adunka et al.

(10) Patent No.: US 7,760,055 B2
(45) Date of Patent: Jul. 20, 2010

(54) METHOD AND DEVICE FOR THE SECURE OPERATION OF A SWITCHING DEVICE

(75) Inventors: Robert Adunka, Sulzbach-Rosenberg (DE); Peter Hartinger, Bodenwöhr (DE); Bardo Koppmann, Kaltenbrunn (DE); Norbert Mitlmeier, Ursensollen (DE); Ludwig Niebler, Laaber (DE); Fritz Pohl, Hemhofen (DE); Alf Wabner, Amberg (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 61 days.

(21) Appl. No.: 11/793,770

(22) PCT Filed: Dec. 22, 2005

(86) PCT No.: PCT/EP2005/057078

§ 371 (c)(1),
(2), (4) Date: Jun. 22, 2007

(87) PCT Pub. No.: WO2006/069960

PCT Pub. Date: Jul. 6, 2006

(65) Prior Publication Data

US 2008/0129430 A1 Jun. 5, 2008

(30) Foreign Application Priority Data

Dec. 23, 2004 (DE) ..... 10 2004 062 269

(51) Int. Cl.
*H01H 75/00* (2006.01)
*H01H 77/00* (2006.01)
*H01H 83/00* (2006.01)
*H01H 67/02* (2006.01)
*H01H 3/00* (2006.01)

(52) U.S. Cl. ..... 335/8; 335/185; 335/132

(58) Field of Classification Search ..... 335/8–10
See application file for complete search history.

(56) References Cited

U.S. PATENT DOCUMENTS 2,695,345 A * 11/1954 Scott, Jr. ..... 335/10

(Continued)

FOREIGN PATENT DOCUMENTS

DE 42 05 204 A1 8/1993

(Continued)

*Primary Examiner*—Lincoln Donovan
*Assistant Examiner*—Alexander Talpalatskiy
(74) *Attorney, Agent, or Firm*—Harness, Dickey & Pierce, P.L.C.

(57) ABSTRACT

A method and a device are disclosed for the secure operation of a switching device including at least two main contacts which can be switched on and off and which includes respectively, contact pieces and a displaceable contact bridge, and at least one control magnet which includes a displaceable anchor. The anchor acts upon the contact bridge when it is switched on and off such that the corresponding main contact is opened or closed. At least one embodiment of the inventive method includes the following steps: a) release device for a force element remains in a first state in order to interrupt the main contact as long as the main contacts are closed when switched on and open when switched off, and b) the release device are transferred into a second state if at least the main contact is welded after switching off.

20 Claims, 3 Drawing Sheets

U.S. PATENT DOCUMENTS

| | | | | | |
|---|---|---|---|---|---|
| 3,958,198 | A * | 5/1976 | Minks | 335/128 |
| 4,206,430 | A * | 6/1980 | Rusch et al. | 335/20 |
| 4,470,028 | A * | 9/1984 | Vayre et al. | 335/16 |
| 4,473,860 | A * | 9/1984 | Thomas | 361/139 |
| 4,495,538 | A * | 1/1985 | Thomas | 361/115 |
| 4,931,757 | A * | 6/1990 | Lemmer et al. | 335/131 |
| 5,163,175 | A * | 11/1992 | Mori et al. | 335/132 |
| 5,252,933 | A * | 10/1993 | Kamino et al. | 335/172 |
| 5,880,658 | A * | 3/1999 | Donhauser et al. | 335/132 |
| 6,150,909 | A * | 11/2000 | Meier | 335/132 |
| 6,411,184 | B1 * | 6/2002 | Comtois et al. | 335/106 |
| 6,566,618 | B2 * | 5/2003 | Hamada et al. | 200/308 |
| 2002/0063049 | A1 * | 5/2002 | Hamada et al. | 200/308 |

FOREIGN PATENT DOCUMENTS

| | | | |
|---|---|---|---|
| DE | 195 11 795 | A1 | 10/1996 |
| DE | 198 49 393 | A1 | 5/2000 |
| EP | 1 089 308 | A2 | 4/2001 |
| EP | 1 089 308 | A3 | 4/2001 |
| EP | 0 832 496 | B1 | 5/2001 |

* cited by examiner

METHOD AND DEVICE FOR THE SECURE OPERATION OF A SWITCHING DEVICE

PRIORITY STATEMENT

This application is the national phase under 35 U.S.C. §371 of PCT International Application No. PCT/EP2005/057078 which has an International filing date of Dec. 22, 2005, which designated the United States of America and which claims priority on German Patent Application number 10 2004 062 269.8 filed Dec. 23, 2004, the entire contents of which are hereby incorporated herein by reference.

FIELD

Embodiments of the invention generally relate to a method for safe operation of a switching device, and/or to a corresponding apparatus.

BACKGROUND

Switching devices, in particular low-voltage switching devices, can be used to switch the current paths between an electrical supply device and loads, and therefore their operating currents. Thus, the switching device opens and closes current paths such that connected loads can be connected and disconnected safely.

An electrical low-voltage switching device such as a contactor, a circuit breaker or a compact starter has one or more so-called main contacts, which can be controlled by one or more control magnets, for switching the current paths. In principle, the main contacts in this case comprise a moving contact link and fixed contact pieces, to which the load and the supply device are connected. An appropriate connection or disconnection signal is passed to the control magnets in order to close and open the main contacts, in response to which the armatures of these control magnets act on the moving contact links such that the contact links carry out a relative movement with respect to the fixed contact piece and neither close nor open the current paths to be switched.

In order to make better contact between the contact pieces and the contact links, appropriately designed contact surfaces are provided at points at which the two meet one another. These contact surfaces are composed of materials such as silver alloys which at these points are applied both to the contact link and to the contact pieces, and have a specific thickness.

The materials of the contact surfaces are subject to wear during every switching process. Factors which an influence this wear are:

- Increasing contact erosion or contact wear as the number of connection and disconnection processes increases,
- Increasing deformation,
- Increasing contact corrosion caused by arcing, or
- Environmental influences, such as vapors or suspended particles, etc.

Thus, the operating currents are no longer safely switched, and this can lead to current interruptions, contact heating or to contact welding.

For example, particularly as the contact erosion increases, the thickness of the materials applied to the contact surfaces is decreased. In consequence, the switching movement between the contact surfaces of the contact link and the contact pieces becomes longer, thus in the end reducing the contact force on closing. As a consequence of this, the contacts no longer close correctly as the number of switching processes increases. The current interruptions resulting from this or else increased connection bouncing can lead to contact heating and thus to increasing melting of the contact material, which can in turn lead to the contact surfaces of the main contacts being welded.

If a main contact in the switching device is worn or welded, the switching device can no longer safely disconnect the load. For example, particularly in the case of a welded contact, at least the current path with the welded main contact will continue to carry currents and be live despite the disconnection signal, so that the load is not completely disconnected from the supply device. Since the load therefore remains in a non-safe state, the switching device represents a potential fault source.

In the case of compact starters according to IEC 60 947-6-2, for example, in which an additional protective mechanism acts on the same main contacts as the control magnet during normal switching, for example, the protective function can thus be blocked.

Fault sources such as these must therefore be avoided for safe operation of switching devices and therefore for protection of the load and of the electrical installation.

SUMMARY

At least one embodiment of the present invention is directed to identifying potential fault sources, and to react appropriately to them.

At least one embodiment of the present invention makes it possible, with little complexity, to identify contact welding during disconnection and thus that the switching device is no longer being operated safely. When contact welding is identified, the force element which is released by the release device breaks open the relevant welded contacts.

According to at least one embodiment of the invention, a release device for a force element for breaking open the main contacts is provided for this purpose, and remains in the first state for as long as the main contacts are closed during connection and are open during disconnection, and which is changed to a second state if at least one of the main contacts is welded after disconnection.

Thus, particularly when the second state occurs, further operation of the switching device can be interrupted even after disconnection. Additionally or alternatively, appropriate warning signals can be produced which indicate the non-safe operation of the switching device.

The method according to at least one embodiment of the invention and the apparatus according to at least one embodiment of the invention therefore ensure safe operation of a multipole switching device, such as a contactor, a circuit breaker or a compact outgoer, and in particular safe operation of a three-pole switching device.

BRIEF DESCRIPTION OF THE DRAWINGS

Further advantageous embodiments and preferred developments will be described in more detail in the following text, with reference to the following figures, in which.

DETAILED DESCRIPTION OF THE EXAMPLE EMBODIMENTS

Figure 1:
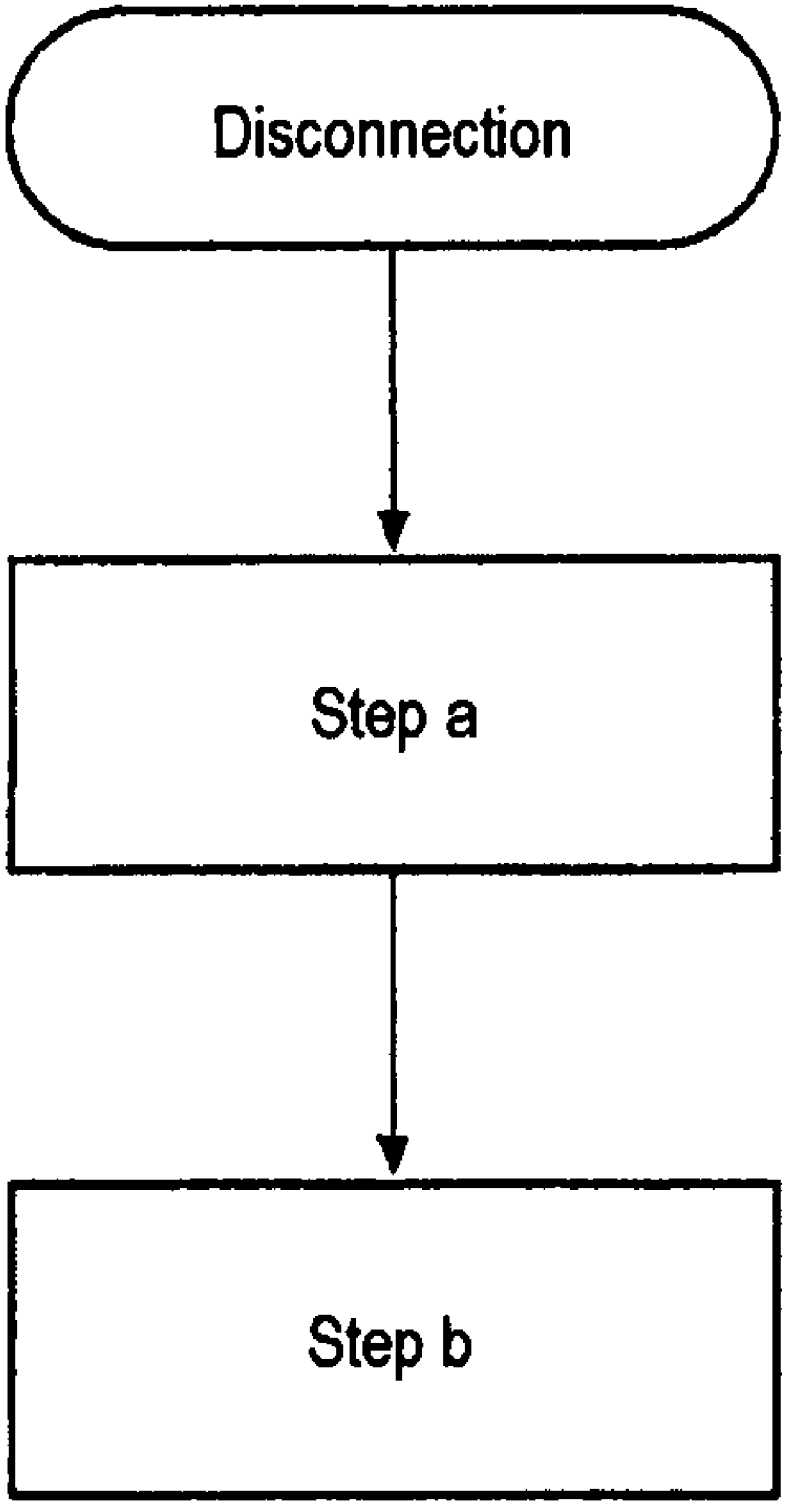
FIG. 1 shows a simplified flowchart of the method according to an embodiment of the invention.

As illustrated in FIG. 1, the method according to an example embodiment of the invention comprises the two following steps:

Step a) a release device for a force element for breaking open the main contacts remains in a first state for as long as the main contacts are closed during connection and are open during disconnection, and Step b) the release device is changed to a second state if at least one of the main contacts is welded after disconnection.

Thus, in particular after correct disconnection of a three-pole switching device having three main contacts for switching three current paths, a check was carried out to determine whether all of the main contacts are open. If the contacts of one main contact are welded, then this results in the relevant main contact being broken open.

According to an embodiment of the invention, a release device is provided for a force element for breaking open the main contacts, and remains in a first state for as long as the main contacts are closed during connection and are open during disconnection. The release device is changed to a second state if at least one of the main contacts is welded after disconnection, that is to say the release device releases the force element in this second state. Mechanical device(s) are provided for changing the release device to the second state, and are operatively connected to the contact links and to the release device. In this case, the release device can interrupt further operation of the switching device when the release device have been changed to the second state after disconnection.

Various embodiments of the apparatus according to the invention will be described in more detail in the following text using the example of a three-pole contactor.

Figure 2:
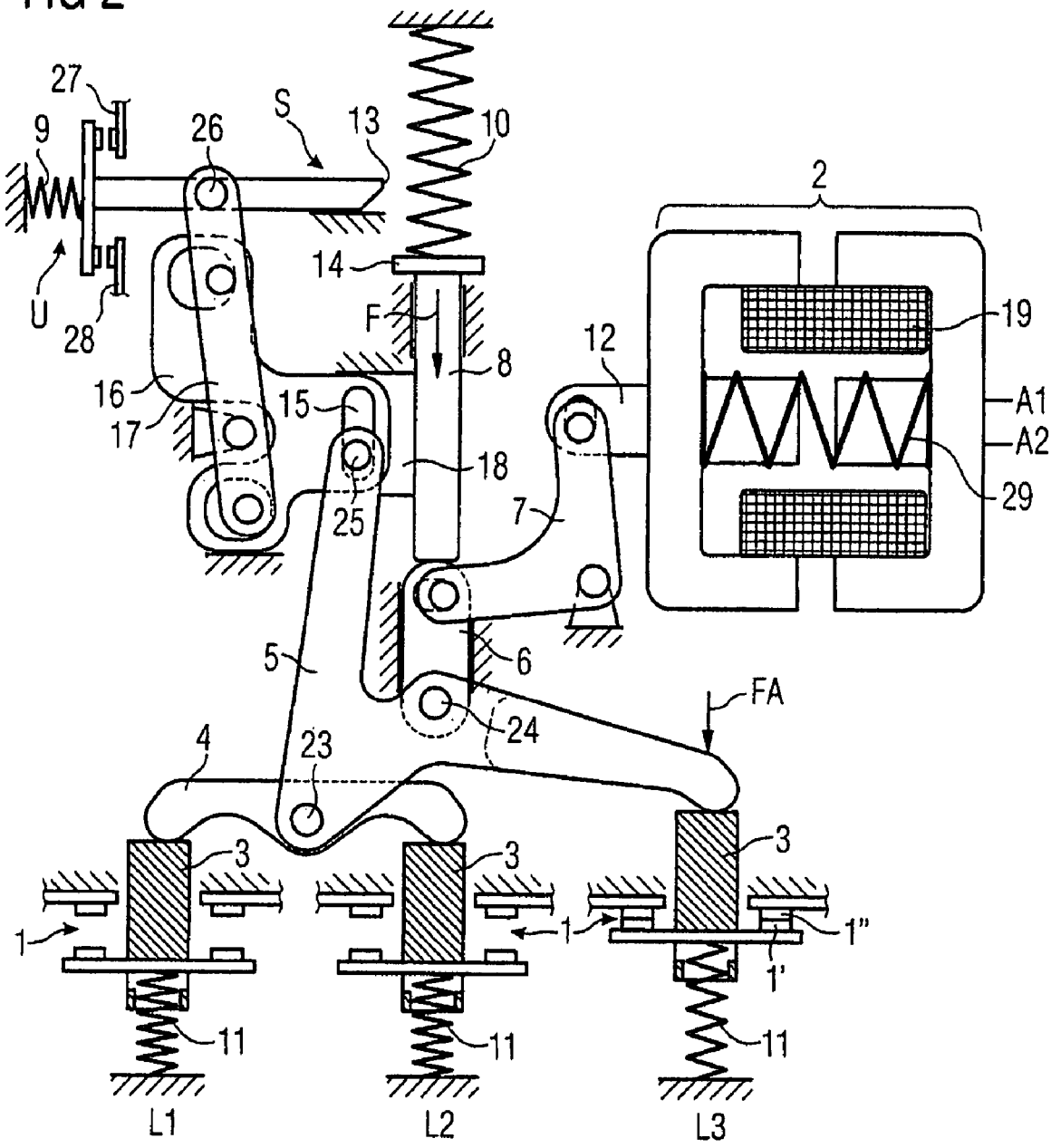
FIG. 2 shows a first embodiment of the apparatus according to the invention, with a welded main contact.

FIG. 2 schematically illustrates the design of a switching device in which the method according to an embodiment of the invention and the apparatus according to an embodiment of the invention are used. A control magnet 2, which acts as an electromagnetic drive for the main contacts 1, can be supplied with current for connection and disconnection via the terminals A1 and A2. During connection, a field coil 19 of the control magnet 2 is normally energized, and is in contrast de-energized during disconnection. In the example shown in FIG. 2, the control magnet 2 is de-energized. The switching device is thus in the disconnected state. The main contacts 1 are in this case opened by the force acting on the contact links from a resetting spring 29 for the electromagnetic drive 2, thus disconnecting the loads from the supply device, in this case indicated by the three pole paths (L1-L3).

According to FIG. 2, as illustrated, during disconnection, an armature 12 of the control magnet 2 acts on the contact slide 3 via an angled lever 7, an operating slide 6 and a large pivoting lever 5 as well as a small pivoting lever 4. The right-hand lever arm, as illustrated, of the large pivoting lever 5 operates the contact slide 3 associated with the pole path L3. The small pivoting lever 4 is mounted, hinged at a fulcrum 23, centrally in the left-hand lever arm of the large pivoting lever 5. The left-hand lever arm of the small pivoting lever 4 in this case operates the contact slide 3 of the left-hand pole path L1, and the right-hand lever arm of the small pivoting lever 4 operates the contact slide 3 of the central pole path L2. The large pivoting lever 5 is mounted at a further fulcrum 24, which is arranged between the lever arms, in the lower part of the operating slide 6. Compensation for the respective operating movements of the contact slides 3 is therefore possible via fixed bearings on the equipment side, via fulcrums 23, 24 and pivoting levers 4, 5.

Furthermore, the example in FIG. 2 shows a fault situation. In this case, at least one main contact 1, in the present case the contact 1' and 1" of the pole path L3 has become welded. The other two main contacts 1 for the pole paths L1 and L2 have in contrast opened after disconnection. Since the contact point 1 of the pole path L3 has been welded, the contact slide 3 for the pole path L3 is blocked. Both the small pivoting lever 4 and the large pivoting lever 5 now pivot, however, such that at least the contact points of the pole paths L1 and L2 are nevertheless opened.

According to an embodiment of the invention, mechanical means 3-5, 16, 17 now change the release device S to the second state, with the mechanical devices 3-4, 16, 17 being operatively connected to the contact links and to the release device S. In the example shown in FIG. 2, the release device S is in the form of a blocking slide and is mechanically operatively connected via a connecting lug 17 and via a compensating plate 16 to a further upper lever arm of the large pivoting lever 5, as well as to the small pivoting lever 4 and to the contact slides 3. The further upper lever arm of the large pivoting lever 5 is guided by way of a bolt 25 in an elongated hole 15 in the compensating plate 16 such that the bolt 25 strikes a stop in the elongated hole 15 when a main contact 1 has been welded, so that the two pivoting levers 4, 5 can carry out a compensating pivoting movement with respect to one another. The force which acts as a result of the compensating pivoting movement is transferred via the stop to the compensating plate 16, which itself moves the connecting lug 17, as a result of a compensating movement.

Finally, the connecting lug 17 operates the release device S and the blocking slide. The blocking slide S thus releases a force element 10, such as the spring energy store 10 shown in FIG. 2. The spring energy store 10 applies a corresponding force F on the upper face of the operating slide 6, via a plunger 8. A portion of this force then acts as a breaking-open force FA on the contact slide 3 of the welded main contact 1. The compensating movement of the upper limb of the large pivoting lever 5 is then restricted in the upward direction by the bolt 25 in the elongated hole 15. The bolt 25 acts as a torque support there for the large pivoting lever 5.

In the illustrated fault situation, the spring energy store 10 is released by a blocking tooth 13 on the blocking slide S moving out of a restraint web 14 of the plunger 8. During correct operation, in which case the release device S is in the first state, the spring energy store 10 (which, by way of example, is in the form of a cylindrical spring) is therefore preloaded.

FIG. 2 actually shows the state of the switching device in which the spring energy store 10 has been released, and the welded contacts 1, 1" of the main contact 1 in the right-hand current path L3 have actually not yet been disconnected.

In order to prevent further operation, appropriate measures such as the blocking of the further drive for the control magnet 2 or the unlatching of a correspondingly powerful spring energy store 10 to break open the welded contacts 1, 1" must then be carried out. In a fault situation such as this, further operation of the switching device should ideally be blocked until a resetting process has been carried out by the user.

According to an embodiment of the invention, the release device S can interrupt further operating of the switching device when, as shown, the release device S is changed to the second state, after disconnection. In the example shown in the present FIG. 2, the force F which the force element 10 applies to the operating slide 6 is in this case sufficiently great that the control magnet 2 cannot overcome it during connection. The main contacts 1 still remain open.

Alternatively or additionally, the release device S or a component which is operatively connected to it can operate an electrical switch U. A message signal can be emitted via this contact U. The electrical connections 27, 28 may, however, also be connected in series with the electrical power supply for the field coil 29 of the control magnet 2. Thus, once the release device S has been changed to the second state, the electrical power supply is still interrupted by the electrical switch U if a connection attempt is made. The main contacts 1 still remain open.

Figure 3:
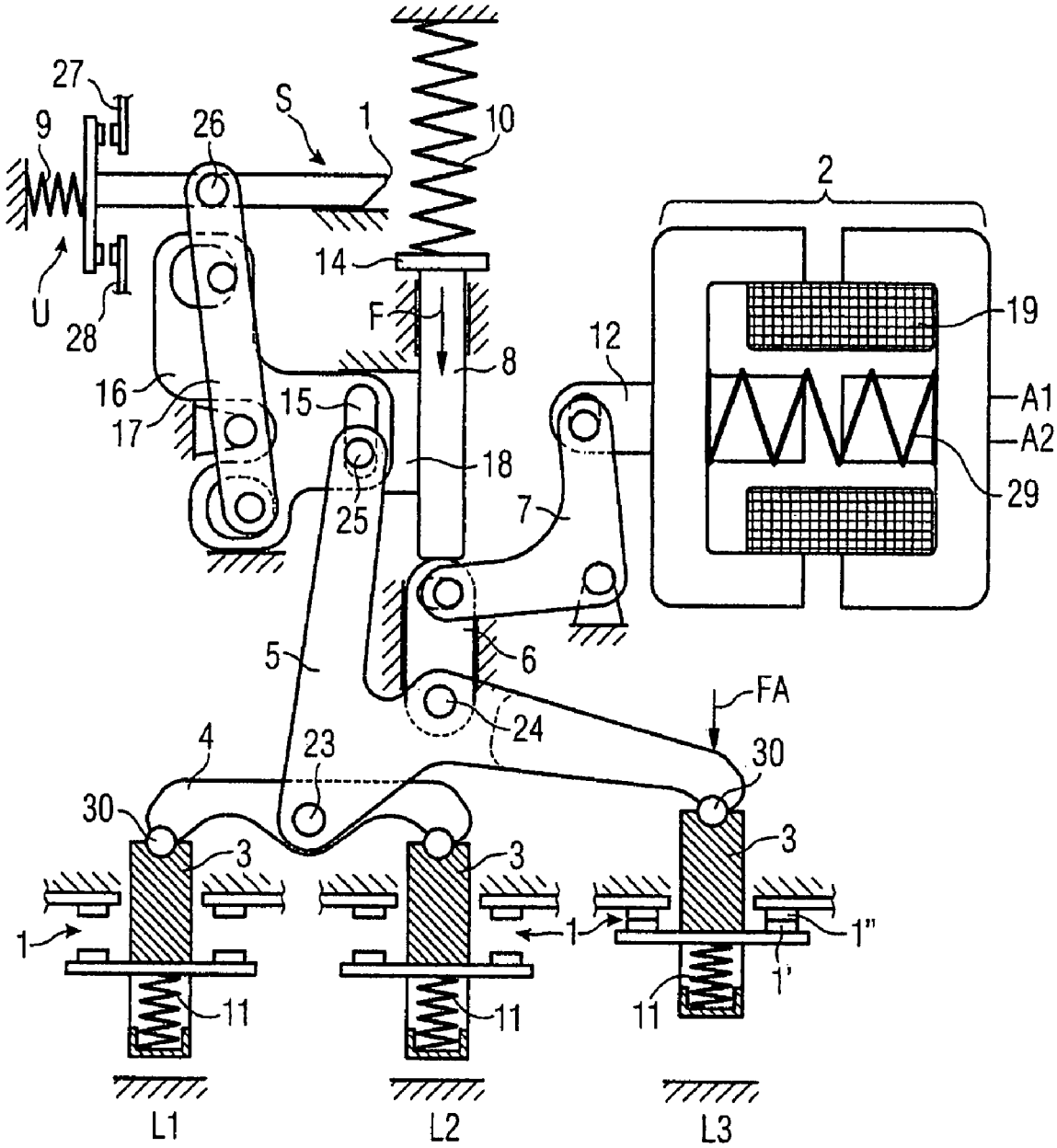
FIG. 3 shows a second embodiment of the apparatus according to the invention, with a welded main contact.

FIG. 3 shows a second embodiment of the apparatus according to the invention with a welded main contact 1. FIG. 3 in this case shows a modification of the embodiment illustrated in FIG. 2. In contrast to FIG. 2, the contact load springs 11 are not supported on a housing of the switching device, but in the contact slide 3 itself. For this purpose, the three contact slides 3 are connected in a hinged manner to the pivoting levers 4, 5 by way of bearings and bolts 23, 24 and 30.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for safe operation of a switching device including at least two main contacts, each being connectable and disconnectable and each including contact pieces and a moving contact link, the switching device further including at least one control magnet which has a moving armature, the armature acting on the contact link during respective connection and disconnection such that the corresponding main contact is respectively closed and opened, the method comprising:

a) maintaining a release device and a force element in a same position relative to the main contacts, corresponding to a first state, when the main contacts are closed during connection and when the main contacts are open during disconnection by contacting a blocking tooth on the release device with a restraint web on the force element; and b) changing the release device and the force element to a different position relative to the main contacts, corresponding to a second state, for breaking open the main contacts if at least one of the main contacts is welded after disconnection by releasing the contact tooth from the restraint web.

2. The method as claimed in claim 1, wherein the release device is changed to the second state via at least one mechanical element, operatively connected to the contact links and to the release device.

3. The method as claimed in claim 1, wherein further operation of the switching device is interrupted when the release device is changed to the second state after disconnection.

4. An apparatus for safe operation of a switching device, the switching device, comprising:

at least two main contacts, each being connectable and disconnectable and each including contact pieces and a moving contact link;

at least one control magnet which has a moving armature, the armature acting on the contact link during respective connection and disconnection such that the corresponding main contact is respectively closed and opened;

a release device having a blocking tooth, the release device being operatively connected to the at least one control magnet;

a force element having a restraint web thereon, the force element being configured to break open the at least two main contacts, wherein the release device and the force element are configured to remain in a same position relative to the main contacts, corresponding to a first state, and the blocking tooth and the restraint web are in contact in the first state, and wherein the main contacts are closed during connection and are open during disconnection, and the release device and the force element are configured to change to a different position relative to the main contacts, corresponding to a second state, when at least one of the main contacts is welded after disconnection.

5. The apparatus as claimed in claim 4, further comprising at least one mechanical element configured to change the release device to the second state, the at least one mechanical element being operatively connected to the contact link and to the release device.

6. The apparatus as claimed in claim 4, wherein the release device is further configured to interrupt further operation of the switching device when the release device has been changed to the second state after disconnection.

7. A switching device, to carry out the method as claimed in claim 1 for safe switching of loads, the switching device being at least one of a contactor, a circuit breaker and a compact outgoer.

8. A switching device for safe switching of loads, comprising:

an apparatus as claimed in claim 4, wherein the switching device is at least one of a contactor, a circuit breaker and a compact outgoer.

9. The switching device as claimed in claim 8, wherein the switching device is a three-pole switching device with three main contacts for connection and disconnection of three current paths with one control magnet.

10. The method as claimed in claim 2, further including interrupting operation of the switching device when the release device has been changed to the second state after disconnection.

11. The apparatus as claimed in claim 5, wherein the release device is further configured to interrupt further operation of the switching device when the release device has been changed to the second state after disconnection.

12. A switching device, to carry out the method as claimed in claim 2 for safe switching of loads, the switching device being at least one of a contactor, a circuit breaker and a compact outgoer.

13. A switching device, to carry out the method as claimed in claim 3 for safe switching of loads, the switching device being at least one of a contactor, a circuit breaker and a compact outgoer.

14. A switching device for safe switching of loads, comprising:

an apparatus as claimed in claim 5, wherein the switching device is at least one of a contactor, a circuit breaker and a compact outgoer.

15. The switching device as claimed in claim 14, wherein the switching device is a three-pole switching device with three main contacts for connection and disconnection of three current paths with one control magnet.

16. A switching device for safe switching of loads, comprising:

an apparatus as claimed in claim 6, wherein the switching device is at least one of a contactor, a circuit breaker and a compact outgoer.

17. The switching device as claimed in claim 16, wherein the switching device is a three-pole switching device with three main contacts for connection and disconnection of three current paths with one control magnet.

18. An apparatus for safe operation of a switching device, the switching device, comprising:

at least two main contacts, each being connectable and disconnectable and each including contact pieces and a moving contact link;

at least one control magnet which has a moving armature, the armature acting on the contact link during respective connection and disconnection such that the corresponding main contact is respectively closed and opened;

release means for releasing a force element having a restraint web thereon, the release means including a blocking tooth and configured for breaking open the main contacts, the release means remaining in a same position relative to the main contacts, corresponding to a first state, the blocking tooth and the restraint web being in contact in the first state, wherein the main contacts are closed during connection and are open during disconnection, and the release means changing to a different position relative to the main contacts, corresponding to a second state, when at least one of the main contacts is welded after disconnection; and mechanical means for changing the release means to the second state, the at least one mechanical means being operatively connected to the contact links and to the release means.

19. The apparatus as claimed in claim 18, wherein the release means interrupts further operation of the switching device when the release means has been changed to the second state after disconnection.

20. A switching device for safe switching of loads, comprising:

an apparatus as claimed in claim 18, wherein the switching device is at least one of a contactor, a circuit breaker and a compact outgoer.

* * * * *